United States Patent [19]

Woodruff

[11] Patent Number: 4,480,940

[45] Date of Patent: Nov. 6, 1984

[54] FLEXIBLE DIAPHRAGM FOR DISPENSING PRODUCT

[75] Inventor: Keith F. Woodruff, Mountainside, N.J.

[73] Assignee: American Cyanamid Company, Stamford, Conn.

[21] Appl. No.: 558,700

[22] Filed: Dec. 6, 1983

Related U.S. Application Data

[63] Continuation of Ser. No. 368,327, Apr. 14, 1982, abandoned.

[51] Int. Cl.[3] ..... A45D 34/00; B05C 17/00

[52] U.S. Cl. ..... 401/206; 401/148; 401/202; 401/207; 401/214; 401/264; 401/273

[58] Field of Search ..... 401/148, 205, 206, 207, 401/214, 264, 273, 202

[56] References Cited

U.S. PATENT DOCUMENTS

| | | | |
|---|---|---|---|
| 2,095,423 | 10/1937 | Tilley | 401/207 |
| 2,749,566 | 6/1956 | Thomas | 15/132.7 |
| 2,923,957 | 2/1960 | Gentile | 15/132.7 |
| 2,996,750 | 8/1961 | Cholet | 401/206 |
| 2,998,616 | 9/1961 | Gentile | 15/572 |
| 3,340,561 | 9/1967 | Schwartzman | 401/206 X |
| 3,355,239 | 11/1967 | Albrecht | 401/148 |
| 4,050,826 | 7/1977 | Berghahn et al. | 401/196 |
| 4,111,567 | 9/1978 | Berghahn et al. | 401/205 X |

FOREIGN PATENT DOCUMENTS

| | | | |
|---|---|---|---|
| 942622 | 2/1949 | France | 401/264 |
| 1252736 | 12/1960 | France | 401/214 |

*Primary Examiner*—Steven A. Bratlie

*Attorney, Agent, or Firm*—Charles J. Fickey

[57] ABSTRACT

Device for applying liquid materials to the skin, the device having a liquid container, a poromeric plastic applicator head, and a diaphragm spring holding the applicator in said device. The diaphragm spring provides a liquid tight seal between the poromeric applicator head and the liquid container and also allows movement of the poromeric applicator head in a vertical direction to create a pressure within the liquid container and provide force to aid in moving the liquid through the poromeric applicator head to its outer surface.

8 Claims, 5 Drawing Figures

FLEXIBLE DIAPHRAGM FOR DISPENSING PRODUCT

This application is a continuation, of application Ser. No. 368,327, filed Apr. 14, 1982 now abandoned.

The present invention relates to a liquid applicator for dispensing toiletries to the skin, and particularly for the application of antiperspirants and deodorants to the human axilla.

Liquid applicators in general are well-known in the prior art, particularly the roll-on type commonly for antiperspirants and deodorants. These are disclosed, for example, in U.S. Pat. Nos. 2,749,566; 2,923,957; and 2,998,616. Because of problems with roll-on type applicators, Berghahn et al., U.S. Pat. Nos. 4,050,826 and 4,111,567, devised a liquid applicator comprising a container fitted with a head having a fixed, shaped form made of a non-flexible, non-deformable, sintered porous synthetic plastic resin having a controlled porosity and having omni-directional, interconnecting pores. The liquid overflow problems associated with conventional roll-ons is also present with this type of head and is solved by the provision of a liquid collecting channel adjacent the shaped applicator, permitting the excess liquid to drain back via the channel into an opening through the head into the liquid reservoir. This avoids an accumulation of liquid on the surface of the applicator and resulting crystallization of product being delivered.

In a real sense, the porous plastic applicator of Berghahn et al. resembles the conventional roll-on applicator except that it is stationary and has a drain channel. The liquid product being delivered must be brought into contact with the applicator head in order for the liquid to be delivered to the surface by capillary action. This requires inverting the container, as is true of the roll-on type of head, since there will always be dead space between the liquid in the reservoir and the applicator head. Thus, no way is provided for the liquid in the reservoir always to be in contact with the applicator head.

In copending commonly assigned Application Ser. No. 86,225, filed Oct. 18, 1979, is disclosed a delivery system for liquid toiletry products whereby a liquid product is absorbed onto an absorbent material which is in intimate contact with a non-flexible, non-deformable, sintered, porous synthetic plastic resin applicator having a controlled porosity and omni-directional interconnecting pores, and whereby the absorbed liquid product is continuously delivered to the porous applicator head by capillary flow on demand.

The device has the advantage of eliminating dead air space and the need to invert the container, since the liquid is always in contact with the applicator head and available on demand at the surface of the applicator head.

Although the dispersing device of the copending Application Ser. No. 86,225, resulted in a greatly improved control of flow and distribution of product, it was found the flow of product through the porous applicator head by capillary action was still not as great as desirable. This was due to the fact that product is removed from the surface of the applicator head by the user faster than the product it provided from and through the head by capillary flow. It has now been found that this difficulty may be overcome by the use of the present invention which generates internal pressure to supplement capillary action when the porous plastic dispensing head of the container is pressed against the skin. Pressure is created by a reduction of the container internal volume as the porous plastic head, mounted in a spring means, travels back into the container. When the porous head is no longer pressed against the skin, it returns to normal position.

In the present invention, the applicator head may be of any suitable configuration, but a convex outer surface has been found to be particularly suitable for contact with various parts of the human body. Thus, the applicator head may have a hemispherical outer surface.

The materials which are used to make the shaped applicator head are non-flexible, non-deformable, sintered, porous synthetic resins having a controlled porosity and having omni-directional interconnecting pores, formed of aggregates of united polymer particles. The degree of porosity of the porous materials can be controlled in their manufacture, thus insuring a wide range of porosity to suit a wide range of liquid products of varying viscosities. Sintered, porous applicator heads may be fabricated of high-density polyethylene, low-density polyethylene, ultra-high molecular weight polyethylene, polypropylene, polyvinylidene fluoride, and the like. Products are available commercially under the trade designations "Porex" porous plastics and "Porous poly." The pore size of the applicator may vary widely, depending on the liquid to be delivered. Low-viscosity liquids, such as perfumes, may best be delivered via a small-pore plastic applicator, e.g., one micron or less. In general, the pore size may vary between about one to 200 microns, and for most purposes, generally about 10–50 microns are preferred.

The porous applicator head fits into an annular plastic diaphragm spring which in turn fits into the top opening of the container which forms a reservoir for the liquid material to be dispensed. The container can be filled solely with the liquid product. As an alternative, the reservoir may contain an absorbent material, onto which the liquid to be delivered is adsorbed, and this absorbent material is in direct and intimate contact with the porous applicator head. This aspect of the invention insures continuous contact of the liquid with the applicator head and ease of delivery of the liquid on demand by capillary flow. The absorbent material used in the reservoir may be any material capable of absorbing the liquid to be delivered, such as cellulose acetate, polyester, cotton, rayon, nylon, or other suitable material, and capable of transferring the liquid therefrom continuously on demand by capillary flow (wicking). The absorbent material may take any suitable shape or form. In one embodiment, the absorbent material is the same non-deformable, non-flexible, sintered, porous synthetic resin material from which the applicator head is constructed. The form may vary, but a particularly advantageous delivery system will consist essentially of a container to hold the contents to be delivered, fitted with the porous head having a cylindrical porous plastic tube extending to the bottom of the container, and having a hemispherical top. The diameter of the cylindrical piece need not be uniform, i.e., the portion extending into the container is of a lesser diameter than the portion extending out of the container in order to fit into the annular plastic spring.

The container may obviously be of any suitable material, such as metal, glass, or plastic.

The delivery system of the invention may be used to deliver any topical liquid product to the skin. These may include, for example, after-shave lotions, pre-shave lotions, skin lubricants or emollients, suntan lotions, fragrances (perfumes, colognes, etc.), topical therapeutics (analgesics, acne formulations, antiseptics, etc.), lip and face rouge and the like. The delivery system is particularly useful in applying antiperspirants and deodorants and avoids the problems associated with roll-on applicators. Thus, the invention provides a means of applying a low viscosity, fast drying, non-sticky solution of aluminum chlorhydrate, avoiding the undesirable features of roll-ons, pump sprays, and sticks.

Since the porous plastic materials are hydrophobic and do not "wet" with water, it may be necessary to add alcohol to an antisperspirant formula to transfer the product from the container to the applicator head. Crystallization of the solid components of the solution, such as aluminum chlorhydrate, may be avoided by the addition of certain esters, such as isopropyl myristate or isopropyl palmitate.

The invention may be better understood by reference to the drawings in which.

Figure 1:
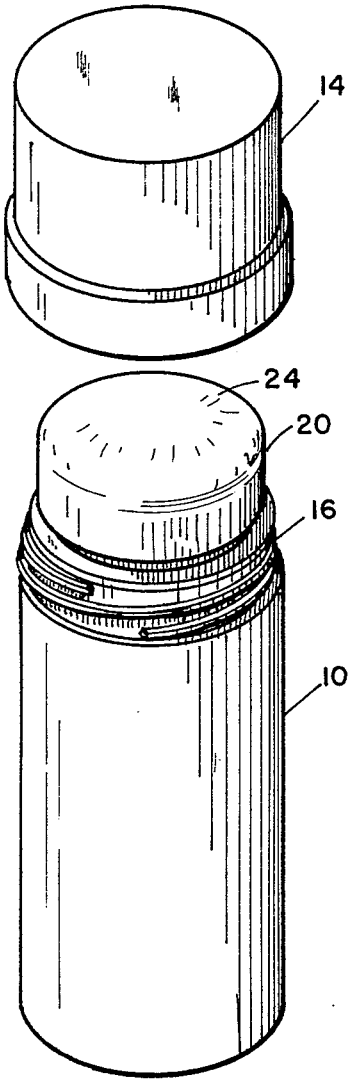
FIG. 1 is a perspective view of the liquid delivery system with the cap of the package removed to show the hemispherical applicator head.
Figure 2:
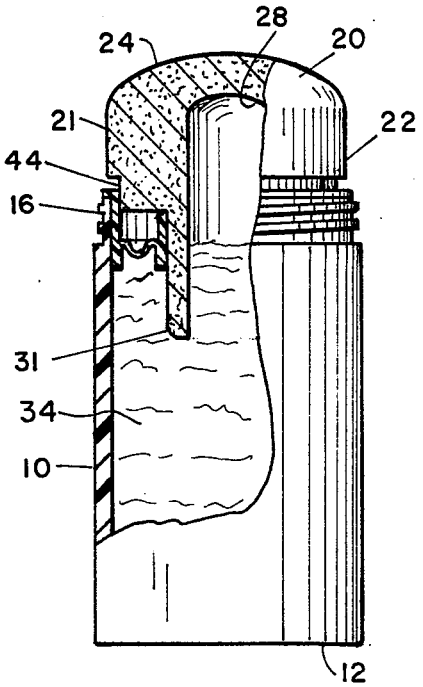
FIG. 2 is an elevational view with parts broken away to show a cross-section of the applicator head diaphragm spring and reservoir.

Referring to the FIGS. 1 and 2, the liquid delivery system comprises an outer case 10 having a base 12 and a cap 14 which is attached by means of threads 16 at the top of case 10. It will be understood that cap 14 could be attached by a friction fit also. Case 10 contains the liquid product 34 to be dispensed. A porous plastic applicator head 20 is fitted into an annular elastic spring 35 through central opening 41 of spring 35. Spring 35 has two concentric cylindrical segments, cylindrical segment 36 with a flange 37 on the top and an inner cylindrical segment 38. The outer cylindrical segment 36 and inner cylindrical segment 38 are joined by an annular undulate member 39, having an annular undulation 40. As shown, undulation 40 is downward. Applicator head 20 has an inner cylindrical portion 31 which fits into opening 41 of spring 35 in a fluid tight relationship. Applicants head 20 has an outer cylindrical portion 44 which fits within outer cylindrical segment 36. The applicator head-spring assembly is inserted into container 10 and the outer segment 36 of spring 35 forms a fluid tight friction fit with flange 38 resting on the top rim 42 of container 10. In this position, the outer cylinder 44 of the applicator head 20 extends within outer cylindrical segment 36 of spring 25. In this arrangement the head 20 can move into the container 10 when pressure is applied to the head and the undulate surface 39 of spring 35 is deformed. Applicator head 20 may be depressed until the shoulder 22 of head 20 contacts flange 37 of spring 35 which then acts as a stop. Container 10 is filled with liquid product 34 and the product is delivered to the surface of head 20 by first wetting the inner surface 28, and then by capillary flow through the pores of head 20. When the outer surface 24 of head 20 is rubbed against the skin, liquid product 34 is applied to the skin. The pressure on head 20 pushes the head into container 10 increasing the pressure in the container, forcing liquid 34 out through the pores of head 20, thus supplementing the capillary flow and assuring an adequate flow of liquid product 34 to the outer surface of head 20. In the embodiment shown in FIG. 2, applicator head 20 has a somewhat flattened outer surface 24 with the vertical side section 21 being thicker than the upper surface 24. This serves two purposes. First, it will allow the preferential flow through the upper surface 24, thus minimizing any liquid dripping down the sides of head 20 and container 10. Second, the flattened head provides a larger spreading area for spreading the liquid 34 over a surface. Any liquid that runs down the sides will be reabsorbed by the thickened area 22 of head 20, this is particularly true when pressure is released on head 20 and air is drawn back into container 10 through the pores of head 20. An advantageous alternative, is to provide a slight degree of flexibility to the upper surface 24 of head 20, either by thinning this area, or by molding the head of a material which will provide this flexibility.

Figure 3:
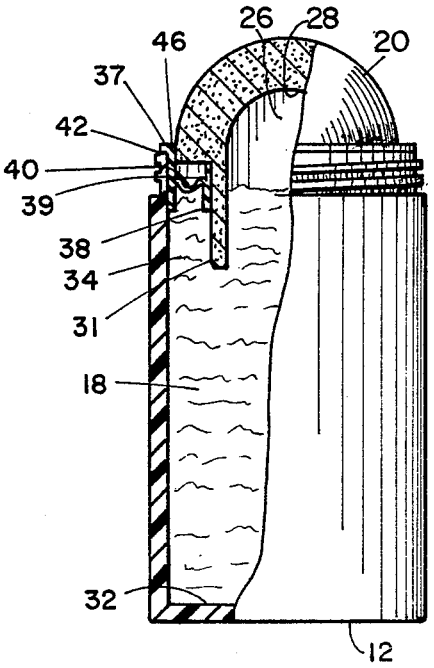
FIG. 3 is an elevational view with parts broken away of an alternative applicator head construction.
Figure 5:
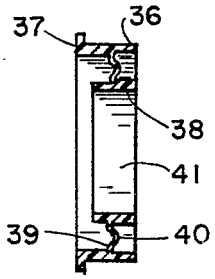
FIGS. 4 and 5 are respectively a top plan view and an elevational view in cross-section of the annular plastic spring.
Figure 4:
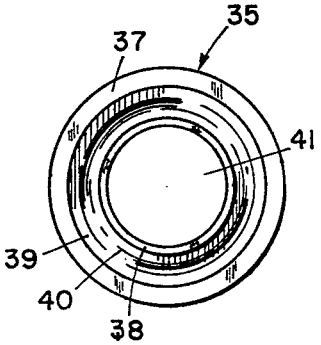

In the embodiment shown in FIG. 3, the applicator head has an inner cylinder 31 which fits within opening 41 of spring 35. The lower edge 46 of head 20 fits within the outer cylindrical segment 36 of spring 35. When applicator head 20 is depressed, the shoulder at edge 46 will contact undulate surface 39 of spring 35, thus stopping downward movement of head 20.

To facilitate wetting of applicator head 20, case 10 may be filled with an absorbent material 18 filling space 26 and in contact with inner surface 28 of applicator head 20.

It will be obvious that other variations of the applicator head may be made. For example, the cylinder rod 31 may be a solid rod, or it may consist of segments rather than a complete cylinder.

A variety of liquid products may be dispensed by means of the invention. Illustrative products are set forth in the following specific Examples.

AFTER SHAVE LOTIONS

EXAMPLE 1—after shave lotion

| | % Weight |
|---|---|
| Alcohol (SDA-40 or 39C) | 60.00 |
| Propylene Glycol | 3.00 |
| Water, deionized | 36.00 |
| Fragrance | 1.00 |

EXAMPLE 2—after shave lotion (high emollience)

| | % wt. |
|---|---|
| Alcohol (SDA-40) | 75.00 |
| Di-isopropyl Adipate | 10.00 |
| Propylene Glycol | 5.00 |
| Water, deionized | 9.25 |
| Fragrance | 0.75 |

EXAMPLE 3—after shave lotion (low alcohol, antiseptic)

| | %/wt. |
|---|---|
| Alcohol (SDA-40) | 40.000 |
| Hyamine 10X (Rohm & Haas) methyl benzethonium chloride | 0.250 |
| Menthol | 0.005 |

-continued

| | %/wt. |
|---|---|
| Ethyl p-aminobenzoate | 0.025 |
| Water, deionized | 59.720 |
| Fragrance | q.s. |

PRE-SHAVE LOTIONS

EXAMPLE 4—pre-shave (beard softener and lubricant)

| | %/wt. |
|---|---|
| Alcohol (SDA-40) | 80.00 |
| Di-isopropyl Adipate | 5.00 |
| Menthol | 0.05 |
| Propylene Glycol | 3.70 |
| Lactic Acid (80%) | 0.30 |
| Water, deionized | 9.95 |
| Perfume | 1.00 |

EXAMPLE 5—pre-shave lotion

| | %/wt. |
|---|---|
| Standamul G (Henkel) (octyl dodecanol) | 10.00 |
| Alcohol (SDA-40) | 90.00 |
| Perfume, Color, Preservatives | q.s. |

EXAMPLE 6—suntan liquid

| | %/wt. |
|---|---|
| Ucon Fluid LB-625 (Union Carbide) PPG-24 Butyl ether | 60.775 |
| Alcohol, SDA-40 (95%) | 30.000 |
| Homomenthyl Salicylate | 8.000 |
| Perfume | 1.200 |
| Color (1% FD & C Yellow #6) | 0.025 |

EXAMPLE 7—sunscreen liquid

| | %/wt. |
|---|---|
| Propylene Glycol para Amino Benzoate | 4.0 |
| Tween 20 (polyoxyethylene sorbitan monolaurate) | 9.0 |
| Alcohol SDA-40 (95%) | 45.0 |
| Water | 42.0 |

FRAGRANCE

EXAMPLE 8—cologne (men's or ladies)

| | %/wt. |
|---|---|
| Alcohol SDA-40 | 80–90 |
| Perfume | 4–6 |
| Water, deionized | 4–16 |

TOPICAL THERAPEUTICS

EXAMPLE 9—analgesic (for relief of muscular pain)

| | %/wt. |
|---|---|
| Methyl Salicylate | 10.00 |
| Oleoresin Capsicum | 1.00 |
| Methyl Nicotinate | 0.25 |
| Isopropyl Myristate | 5.00 |
| Alcohol SDA-40 | 83.75 |

EXAMPLE 10—acne treatment

| | %/wt. |
|---|---|
| Salicylic Acid | 3.00 |
| Boric Acid | 2.00 |
| Methyl Benzethonium Chloride | 0.08 |
| Isopropyl Alcohol | 63.00 |
| Water, deionized | 31.92 |

EXAMPLE 11—antiperspirant

| | %/wt. |
|---|---|
| Aluminum Chlorhydrate (50% aq.) | 50.0 |
| Ceraphyl 41 (Van Dyk) ($C_{12}$–$C_{15}$ Alcohol-lactate ester) | 5.0 |
| SD-40 Ethanol (190) | 45.0 |

What is claimed is:

1. A liquid applicator suitable for use in the application of liquids to a surface of the human body comprising a container having a container body adapted for storing a quantity of liquid, said container having an opening at the upper end thereof; annular spring means said annular spring means comprising outer and inner concentric cylindrical segments joined by an undulate annular planar member, said spring means being positioned in said container, applicator means being secured in said spring means; said annular spring means forming a liquid tight seal between said applicator means and said container body; said applicator means comprising a non-flexible, non-deformable, sintered, porous synthetic resin structure having a controlled porosity and having omni-directional interconnecting pores.

2. The liquid applicator of claim 1 wherein said outer cylindrical segment of said spring means fits in the opening of said container.

3. The liquid applicator of claim 1 wherein said applicator means fits in the inner of said concentric cylindrical segments.

4. The liquid applicator of claim 1 wherein the upper edge of said inner cylindrical segment is lower in an axial direction than the upper edge of said outer cylindrical segment.

5. The liquid applicator of claim 1 wherein said undulate planar member has a downward annular undulation.

6. The liquid applicator of claim 1 wherein said container contains an absorbent reservoir means for a quantity of liquid.

7. The liquid applicator of claim 6 wherein said reservoir means comprises a natural or synthetic fibrous material.

8. The liquid applicator of claim 1 comprising in addition a cap fitted over said applicator means.

* * * * *